US005334235A

United States Patent [19]

Dorfman et al.

[11] Patent Number: 5,334,235

[45] Date of Patent: Aug. 2, 1994

[54] THERMAL SPRAY METHOD FOR COATING CYLINDER BORES FOR INTERNAL COMBUSTION ENGINES

[75] Inventors: Mitchel R. Dorfman, Smithtown; Jorge E. Garcia, Farmingdale; Burton A. Kushner, Old Bethpage, all of N.Y.

[73] Assignee: The Perkin-Elmer Corporation, Norwalk, Conn.

[21] Appl. No.: 7,701

[22] Filed: Jan. 22, 1993

[51] Int. Cl.[5] ..... C22C 37/10

[52] U.S. Cl. ..... 75/255; 420/27

[58] Field of Search ..... 75/252, 255; 420/27, 420/28

[56] References Cited

U.S. PATENT DOCUMENTS

| | | | |
|---|---|---|---|
| 2,588,422 | 3/1952 | Shepard | 309/3 |
| 3,077,659 | 2/1963 | Holzwarth et al. | 29/197 |
| 3,322,515 | 5/1967 | Dittrich et al. | 29/191.2 |
| 3,617,358 | 11/1971 | Dittrich et al. | 117/105.2 |
| 3,819,384 | 6/1974 | Ingham et al. | 106/1 |
| 3,841,901 | 10/1974 | Novinski et al. | 117/105.2 |
| 3,991,240 | 11/1976 | Harrington et al. | 427/423 |
| 4,416,421 | 11/1983 | Browning | 239/79 |
| 4,578,114 | 3/1986 | Rangaswamy et al. | 75/252 |
| 4,578,115 | 3/1986 | Harrington et al. | 75/255 |
| 4,865,252 | 9/1989 | Rotolico et al. | 239/8 |
| 4,900,199 | 2/1990 | Spaulding et al. | 406/14 |
| 5,006,321 | 4/1991 | Dorfman et al. | 427/192 |
| 5,014,916 | 5/1991 | Trapani et al. | 239/85 |
| 5,080,056 | 1/1992 | Kramer et al. | 123/193 |

FOREIGN PATENT DOCUMENTS

| | | | |
|---|---|---|---|
| 649027 | 9/1962 | Canada | 29/148.2 |
| 2841552 | 3/1980 | Fed. Rep. of Germany | 75/255 |
| 3842263 | 6/1990 | Fed. Rep. of Germany . | |

*Primary Examiner*—George Wyszomierski

*Attorney, Agent, or Firm*—H. S. Ingham; E. T. Grimes; J. R. Wahl

[57] ABSTRACT

A tenacious wear resistant coating is applied with a high velocity oxygen-fuel thermal spray gun using a composite powder of aluminum and an iron base metal. The metal may be iron-chromium, iron-molybdenum, cast iron or a combination. A particular combination is a blend of a first powder and a second powder, the first powder consisting of a composite of aluminum subparticles and iron-molybdenum alloy subparticles, and the second powder consisting of a composite of aluminum subparticles and cast iron subparticles. An internal combustion engine block has such a coating applied to the cylinder walls.

4 Claims, 1 Drawing Sheet

THERMAL SPRAY METHOD FOR COATING CYLINDER BORES FOR INTERNAL COMBUSTION ENGINES

This invention relates to internal combustion engines, and particularly to a method for coating cylinder bores for such engines by thermal spraying, and to cylinder bores coated thereby. The invention also relates to iron base powders particularly useful for high velocity thermal spraying on cylinder bores.

BACKGROUND OF THE INVENTION

Thermal spraying, also known as flame spraying, involves the melting or at least heat softening of a heat fusible material such as a metal, and propelling the softened material in particulate form against a properly prepared surface which is to be coated. The heated particles strike the surface where they quench and bond thereto. In one type of thermal spray gun, a powder of the coating material is fed axially through a low velocity combustion flame. A plasma spray gun utilizes a high intensity arc to heat inert gas in the gun so as to effect a high velocity gas stream ("plasma") into which powder is injected. In a wire type of thermal spray gun, a wire is fed axially through an oxygen-acetylene (or other fuel gas) flame which melts the wire tip. An annular flow of compressed air "atomizes" the molten wire tip into small droplets or softened particles, generally between one and 150 microns in size. Another type is an arc gun in which two wires converge to where an arc between the wires melts the tips, the molten material again being atomized and propelled by compressed air.

High velocity oxygen-fuel ("HVOF") powder thermal spray guns have recently become practical, examples being described in U.S. Pat. Nos. 4,416,421 and 4,865,252. Combustion is effected at high pressure within the gun. With a feed of powder or wire, the combustion effluent is directed through an open channel to produce a high velocity spray steam that results in particularly dense coatings. In most cases gas fuel is used, but liquid fuel is an alternative as suggested in the '421 patent.

German patent No. DE 38 42 263 C1 discloses HVOF spraying of molybdenum with molybdenum oxide. U.S. Pat. No. 5,006,321 discloses a method of producing glass mold plungers with self-fluxing alloy and carbide using HVOF. U.S. Pat. No. 5,080,056 teaches the spraying of cylinder bores and piston skirts of internal combustion engines with aluminum bronze using an arc wire gun or an HVOF type of gun.

Special steps must be taken to assure bonding of spray material to metal substrates. A common method of surface preparation is to roughen the surface with grit blasting. Such blasting is an added step which increases coating costs. In some cases, for example in engine cylinder bores, there is danger of grit particles remaining imbedded to later cause scoring or even destruction. Therefore it is desirable to eliminate the blasting step.

Some thermal spray materials bond well to a smooth, clean substrate, for example sprayed molybdenum wire as disclosed in U.S. Pat. No. 2,588,422 for producing a bond coat which is overcoated with a non-bonding type of thermal spray coating of choice. Molybdenum coatings also proved to provide low scuff wear resistance, and have been in common use on piston rings for internal combustion engines.

U.S. Pat. No. 3,322,515 discloses composite powders of aluminum and another selected metal such as nickel or chromium, to effect an intermetallic compound with an exothermic reaction during flame spraying by a wire, plasma or powder combustion gun. The results generally are improved bonding to smooth machined surfaces. It is stated in the patent (column 4, lines 5–17) that iron is not a satisfactory component for such a composite material, although iron may be combined with another metal sufficient to provide an effective exothermic reaction.

U.S. Pat. No. 4,578,114 discloses a thermal spray composite powder comprising an alloy constituent of nickel, iron or cobalt with aluminum and/or chromium, and elemental constituents aluminum and yttrium oxide. As background, it is indicated therein (column 3, lines 10–17) that chromium as an alloying element in a powder core coated with aluminum improves corrosion resistance, but reduces bond strength. According to the patent yttrium oxide is added to improve the bond strength. A similar powder is disclosed in U.S. Pat. No. 4,578,115 wherein cobalt is the additional component to improve bond strength. Thermal sprayed coatings of both of these types of composite powders are recommended for high temperature applications including cylinder walls of combustion engines. A similar powder is also disclosed in U.S. Pat. No. 3,841,901 wherein molybdenum is an additional component to improve machinability of the coatings.

Iron based coatings in cylinder bores are generally known and desirable for their scuff resistance and lower cost, being especially useful for enhancing aluminum engine blocks. U.S. Pat. No. 3,991,240 discloses a composite powder of cast iron core clad with molybdenum and boron particles, coatings thereof being suggested for plasma spraying onto cylinders walls. U.S. Pat. No. 3,077,659 discloses an aluminum cylinder wall of an internal combustion engine flame sprayed with a mixture of powdered aluminum with 8% to 22% powdered iron. Canadian patent No. 649,027 discloses cast iron sleeves for diesel engines with sprayed layers of molybdenum bond coat, intermediate chromium, and carbon steel final coating. U.S. Pat. No. 3,819,384 suggests coatings containing ferro-molybdenum alloy for various applications including cylinder liners. The aforementioned U.S. Pat. No. 2,588,422 discloses aluminum cylinders with thermal sprayed steels on a molybdenum bond coat.

U.S. Pat. No. 5,080,056 discloses aluminum cylinder bores for automotive engines thermal spray coated with aluminum bronze. These coatings are effected with an arc wire process or a high velocity oxygen-fuel process.

It is well known in the art of thermal spraying that bonding of coatings on the inside bores of cylinders is more difficult than on flat or external cylindrical surfaces. This is because there are inherent shrink stresses in the coatings due to the quenching effects in spray particles on the surface. These stresses are particularly apparent on an inside diameter to cause a coating to pull away and lift off. Moreover, aluminum substrates typically provide lower bond strengths than iron. Therefore, unless a material is self-bonding, an aluminum cylinder bore generally must be grit blasted which, as pointed out above, is undesirable. Exceptions may be spray materials that are soft enough to relieve stresses, such as the bronze of the aforementioned U.S. Pat. No. 5,080,056.

In summary, iron based coatings are of particular interest for applications such as cylinder bores, especially for aluminum alloy engine blocks for decreasing vehicle weights and costs while increasing performance, mileage and longevity. Also of interest is an ability to apply the coatings to smooth machined surfaces in one step without grit blasting. However, iron based coatings apparently have not, so far, been known in practice to bond well to smooth surfaces, even with compositing of aluminum with the iron. This situation is exacerbated for inside aluminum cylinder walls such as in combustion engines.

Therefore, an object of the present invention is to apply iron base thermal spray coatings having improved bonding. Other objects are to effect such coatings by thermal spraying onto smooth surfaces. A further object is to provide an improved method for applying iron base coatings to cylinder bores. Another object is to provide an internal combustion engine block with improved cylinder bore coatings. Yet another object is to provide a novel iron base powder which is particularly useful for thermal spraying in cylinder bores of internal combustion engines.

SUMMARY OF THE INVENTION

Foregoing and other objects of the invention are achieved by a method of applying a tenacious, wear resistant coating to a substrate surface by using a thermal spray gun having a combustion chamber and an open channel for propelling combustion products into the ambient atmosphere. The method comprises preparing the substrate surface to receive a thermal sprayed coating, feeding a selected thermal spray powder through the open channel of the thermal spray gun, injecting into the chamber and combusting therein a combustible mixture of fuel and oxygen at a pressure in the chamber sufficient to produce a spray stream with at least sonic velocity containing the thermal spray powder issuing through the open channel, and directing the spray stream toward the substrate so as to produce a coating thereon. According to the invention, the selected thermal spray powder is a composite powder of aluminum and an iron base metal.

Preferably the iron base metal is an iron-chromium alloy, an iron-molybdenum alloy, cast iron or a combination thereof. Most preferably the composite powder is a blend of an iron-molybdenum powder and a cast iron powder, the iron-molybdenum powder comprising granules each formed of aluminum subparticles and iron-molybdenum alloy subparticles, and the cast iron powder comprising granules each formed of aluminum subparticles and cast iron subparticles.

Objects of the invention are also achieved with an internal combustion engine block advantageously formed of aluminum alloy. The inside surfaces of the combustion cylinders have a coating thereon comprising aluminum and an iron base metal. The inside surfaces can be as-machined surfaces with the coating thereon, the coating advantageously being applied by thermal spraying according to the above-described method.

Objects are further achieved with a specific type of composite thermal spray powder comprising a blend of a first powder and a second powder. The first powder comprises granules each formed of aluminum subparticles and iron-molybdenum alloy subparticles, and the second powder comprises granules each formed of aluminum subparticles and cast iron subparticles.

BRIEF DESCRIPTION OF THE DRAWING

The drawing is an elevation partially in section of the end of an extension on a thermal spray gun used in the invention.

DETAILED DESCRIPTION OF THE INVENTION

Figure 1:
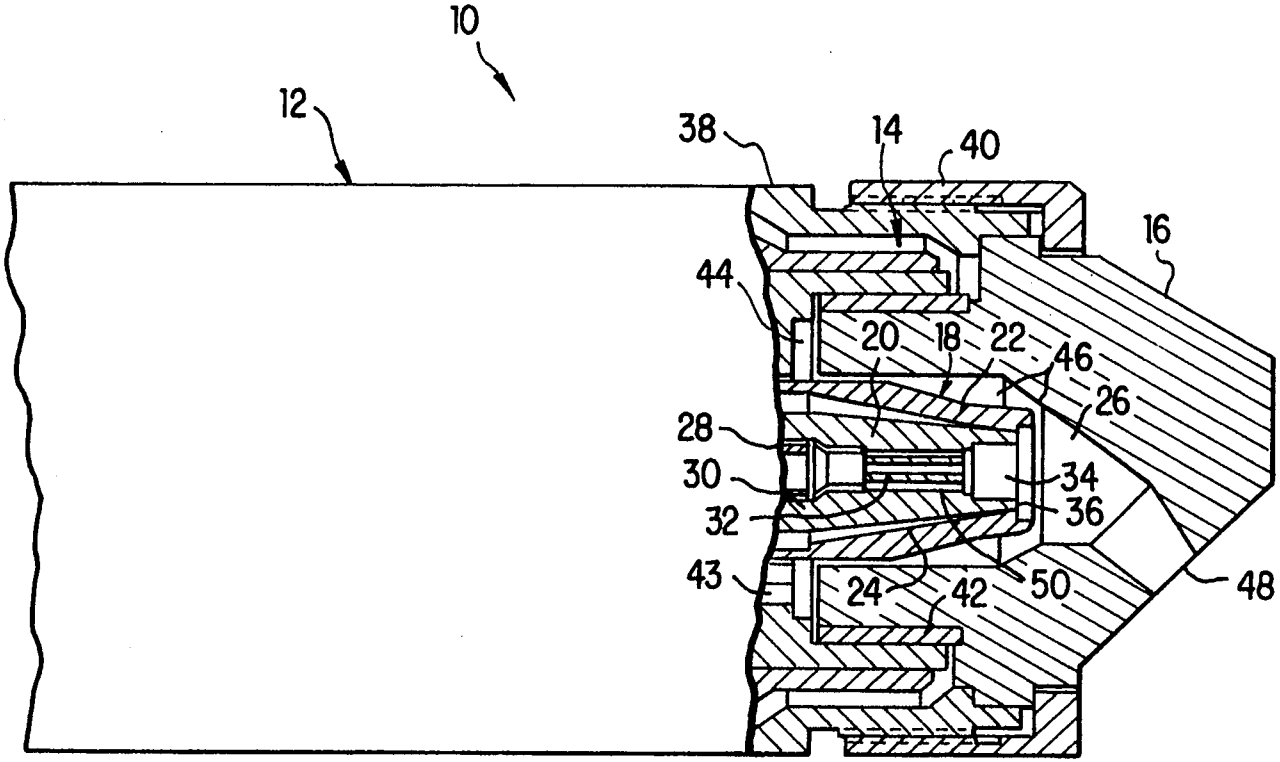

The present invention advantageously is carried out with a high velocity oxyen-fuel thermal spray gun of the type disclosed in the aforementioned U.S. Pat. No. 4,856,252 assigned to the present assignee and fitted with a rotating extension and angular nozzle such as disclosed in U.S. Pat. No. 5,014,916, also of the present assignee. It will be appreciated that other thermal spray guns may also be used, for example the high velocity oxy-fuel gun taught in the aforementioned U.S. Pat. No. 4,416,421, to the extent that the long nozzle of the latter patent may be adapted if necessary for spraying into cylinder bores.

A thermal spray apparatus 10 for carrying out the present invention is of the type disclosed in the aforementioned U.S. Pat. No. 5,014,916 and includes an extension 12 with a burner head 14. A rear gun body (not shown) includes conventional valving and passages for supplying gases, namely fuel, oxygen and air. A gas cap 16 is mounted on the burner head.

A nozzle member 18 is constructed of a tubular inner portion 20 and a tubular outer portion 22. Between the inner and outer portions is an outer annular orifice 24 for injecting an annular flow of a combustible mixture of fuel and oxygen into a combustion chamber 26. This annular orifice instead may be a ring of equally spaced orifices. The combustible mixture is ignited in the chamber.

The nozzle member 18 extends into gas cap 16 which extends forwardly from the nozzle. The nozzle member also is provided with an axial bore 28 with a powder tube 30 therein. A central powder orifice 32 in the nozzle extends forwardly from the tube into a further recess 34 in the nozzle face 36. The nozzle may have an alternative configuration, for example without recesses in the face as described in the U.S. Pat. No. 5,014,916.

The gas cap 16 is attached coaxially to a tubular housing 38 with a threaded retainer ring 40. The gas cap and forward end of the housing are mounted on the gas head by a bearing bushing 42 which allows rotation of the gas cap/housing assembly on the gas head if such is desired in utilizing the extension.

Air is passed under pressure via a passage 43 to an annular chamber 44 and thence into chamber 26 as an outer sheath flow from an annular slot 46 between the nozzle and the gas cap. Forward of the nozzle the cap defines the combustion chamber 26 into which slot 46 exits. The flow continues through the chamber as an outer flow mixing with the inner flows, and out of the outlet end 48 of gas cap 16. The drawing shows a 45° gas cap with an angularly curved passage constituting the combustion chamber 26 extending therethrough.

The radially inner portion 20 of the nozzle member has therein a plurality of parallel inner orifices 50 which provide for an annular inner sheath flow of gas, such as air, between the combustible mixture and the central powder feed issuing from orifice 32 of the nozzle. The inner sheath air flow should generally be between 1% and 10% of the outer sheath flow rate.

The thermal spray gun is operated substantially as described in the aforementioned U.S. Pat. Nos.

4,865,252 and 5,014,916 for a high velocity spray. A supply of each of the gases to the combustion chamber is provided at a sufficiently high pressure, preferably at least two atmospheres (2 bar) above ambient atmospheric pressure, and is ignited so that the mixture of combusted gases and air will issue from the exit end as a supersonic flow, or at least a choked sonic flow, entraining the powder. The heat of the combustion will at least heat soften the powder material so that a coating is deposited onto a substrate.

Shock diamonds should be observable without powder feeding. The combustion gas may be, for example, propane, hydrogen, propylene or methylacetylene-propadiene ("MPS"), for example, a propylene or MPS pressure of about 7 kg/cm$^2$ gauge (above atmospheric pressure) to the gun, oxygen at 10 kg/cm$^2$ and air at 5.6 kg/cm$^2$.

For spraying cylinder bores, in an engine block for an internal combustion engine, the gun extension is attached to the gun body with a motor drive so as to rotate the nozzle, as taught in the aforementioned U.S. Pat. Nos. 5,014,916 and 5,080,056. Spraying is effected during rotation while the gun is oscillated longitudinally in the cylinder bore.

The thermal spray powder utilized in the invention is a composite powder of aluminum and an iron base metal, the powder preferably having a size distribution predominently between about 10 and 60 microns suitable for HVOF. The powder may be made by any of the desired or conventional methods such as described in the aforementioned U.S. Pat. Nos. 3,322,515 or 3,617,358. Preferably powder is made by combining subparticles of the aluminum and iron constituents. The subparticles may be bonded into powder granules by sintering or mechanical alloying, or advantageously by bonding with an organic binder. Methods with such a binder include spray drying as taught in the U.S. Pat. No. 3,617,358, or blending the subparticles with the binder in a solvent in a container and drying while stirring to effect the granules as taught in the U.S. Pat. No. 3,322,515. The dried binder should be present in an amount sufficient for the granules not to be too friable but not so much that the binder interferes with the melting of the metals or contaminates the coating. Generally the dried binder should be between about 0.5% and 5% (e.g. 2.5%) by weight of the powder. After production, the powder is screened or otherwise classified to the desired size range. The binder is burned off during spraying, and the metal ingredients react and coalesce into the coating.

A composite flame spray powder, as the term is understood in the flame spray art and used herein, designates a powder, the individual particules of which contain several components which are individually present, i.e. unalloyed together, but connected as a structural unit forming the powder particles. Thus the aluminum should not be alloyed with the iron constituent in the powder, so that exothermic reaction of the aluminum during spraying will enhance the bonding. With a composite powder size distribution between about 10 microns and 60 microns, the aluminum subparticles should have a size between about one micron and 20 microns, and the iron base subparticles should have a size between about 10 microns and 44 microns. The aluminum should be present in a amount between about 1% and 10% by weight of the total of the aluminum and iron base metal. Due to some loss during spraying, the aluminum content of a sprayed coating is between about 1% and 8%.

The iron base metal constituent preferably is an iron-chromium alloy, an iron-molybdenum alloy, a cast iron or a combination thereof. These alloys may conveniently be selected from readily available iron alloys such as foundry alloys for low cost. The iron-chromium may contain from 5% to 50% chromium (e.g. 25–30%), balance substantially iron. The iron-molybdenum may contain from 50% to 75% molybdenum, balance substantially iron.

The term "cast iron" as used herein and in the claims designates an alloy of iron and carbon usually containing various quantities of silicon, managanese, phosphorus and sulfur, with the carbon present in excess of the amount which can be retained in sold solution in austenite at the eutetic temperature. Alloy cast irons have improved mechanical properties, such as corrosion-, heat- and wear-resistance, and the addition of alloying elements have a marked effect of graphitization. Other common alloying elements in cast iron include molybdenum, chromium, nickel, vanadium, and copper.

Most advantageous is a combination of iron-molybdenum and cast iron. The composite powder of the combination may be formed by any of several ways. One is to pre-blend subparticles of the two ingredients with the aluminum and form the composite powder so that each granule contains both iron constituents as well as the aluminum. Another is to make separate powders with the aluminum, one with iron-molybdenum and the other with cast iron, and then blend the powders. In either case the iron-molybdenum should consist of between about 30% and 70% (e.g. 50%) of the total of the iron-molybdenum and the cast iron. This combination provides the coating with the advantages of special low scuff properties of molybdenum and the lower cost and relatively low scuff of cast iron. This is recommended particularly for cylinder bores of aluminum engine blocks for internal combustion engines.

A composite powder according to the invention may also be admixed with a conventional powder for enhanced properties and/or reduced cost. Up to 50% of conventional powder may generally be used while retaining sufficient bonding by the composite. For example a composite with aluminum and iron-chromium alloy may be blended with simple white cast iron powder of similar size, and sprayed with HVOF according to the invention.

Further ingredients may also be added into the composite granules in the known or desired manner to further enhance properties. For example fine yttria and/or cobalt subparticles may be included as taught in the aforementioned U.S. Pat. Nos. 4,578,114 and 4,578,115 to further increase bonding and corrosion resistance. Boron and/or silicon may be added as oxygen getters, as suggested by the aforementioned U.S. Pat. No. 3,991,240. Molybdenum may be added to improve toughness, as taught in the forementioned U.S. Pat. No. 3,841,901.

It was discovered by the present inventors that composite powders of aluminum and iron base metals thermal sprayed by the high velocity oxy-fuel (HVOF) process bond particularly well to smooth substrates, in contrast to the spraying of such powders by other thermal spray methods (such as according to Example 2 below). Bonding is good, even on smooth aluminum substrates and cylinder bores. Thus such material sprayed by HVOF is especially suitable for aluminum alloy combustion engine cylinders. The coatings will have the typical cross sectional structure of HVOF coatings, viz. laminated lenticular grains representing the flattened particles of powder melted and sprayed at high velocity.

It generally should only be necessary to clean a substrate surface of oil and oxide contaminants in a convenient manner prior to coating. Coatings of iron-base composite powder applied by HVOF up to 500 microns thickness and greater may be spray coated onto mild steel and aluminum substrates prepared by smooth machining, grinding, honing or light emery cleaning. Roughening by rough machining or light or heavy grit blasting may be effected to further increase bonding where practical and needed. However fine powder sprayed by HVOF produces relatively smooth coatings which may carry through substrate irregularities.

The sprayed HVOF coatings are relatively smooth although still having some surface texture typical of thermal spraying. Coatings sprayed according to the invention may be used as-is or may be machined, honed or grind finished in the conventional manner. Another alternative is to spray such a coating as a bond coat, and then apply an overcoat with a material having suitably desired properties or lower cost. For example, a composite of iron-chromium and aluminum may be sprayed to a thickness of about 40 microns and overcoated with HVOF sprayed cast iron. The bond coat may be grit-blast roughened if needed to improve bonding of the overcoat to it. Embedding of grit is less likely to occur in the harder bond coat, compared with aluminum cylinder walls.

Although directed preferably to combustion engines of the piston type, the invention should also be useful for rotary combustion engines or for pump cylinders or the like. Coatings according to the invention may also be used advantageously for other such applications as crankshafts, roll journals, bearing sleeves, impeller shafts, gear journals, fuel pump rotors, screw conveyors, wire or thread capstans, brake drums, shifter forks, doctor blades, thread guides, farming tools, motor shafts, lathe ways, lathe and grinder centers, cam followers and cylindrical valves.

EXAMPLE 1

A white cast iron powder containing 3–4% carbon and having a size of 10 to 44 microns was mixed with aluminum powder having a size of 1 to 20 microns, in a ratio of 90 parts alloy to 10 parts aluminum by weight. A polyvinylpyrolidone (PVP) binder solution containing 60 parts by weight of PVP solids, 30 parts of acetic acid, 3 parts epson salt and 240 parts distilled water was prepared. This binder solution was stirred into the powder mixture, in an amount of 13.3 parts by weight based on the powder. The slurry was heated to 104° C. in a steam-jacketed pot while continuing mixing until a dry mixture was produced. The mixture was screened through a 63 micron (230 mesh) screen to remove larger agglomerates. This produced a composite powder of the aluminum and alloy bonded with about 2.5% binder.

Flat aluminum and mild steel substrates were prepared by solvent cleaning and light emerying to remove oils and oxide contaminants. The composite powder was sprayed on the substrates with an HVOF apparatus described in the aforementioned U.S. Pat. No. 4,865,252, specifically a Metco Type DJ TM Gun sold by Perkin-Elmer, with a jetted #2 insert, #2 injector, "A" shell, and #2 siphon plug. Parameters were oxygen at 10.5 kg/cm$^2$ (150 psig) and 293 l/min (620 scfh), propylene gas at 7.0 kg/cm$^2$ (100 psig) and 79 l/min (168 scfh), and air at 5.3 kg/cm$^2$ (75 psig) and 350 l/min (742 scfh). (These parameter pressures are the gage pressures upstream of the flowmeters, and are sufficient to provide at least 2 bar pressure in the combustion chamber of the gun.) A high pressure powder feeder, of the type disclosed in the present assignee's U.S. Pat. No. 4,900,199 and sold as a Metco Type DJP powder feeder by Perkin-Elmer, was used to feed the powder blend at 2.3 kg/hr (5 lbs/hr) in a nitrogen carrier gas at 8.8 kg/cm$^2$ (125 psig) and 7 l/min (15 scfh). Spray distance was 20 cm (8 inches ).

Coating thicknesses about 500 to 600 microns were applied without lifting. Bond strength measurements according to ASTM C633 showed bond strengths of 175 kg/cm$^2$ (2500 psi).

Excellent ground finishes were obtained using a 60 grit silicon carbide wheel (CG60-H11-VR) at a wheel speed of 5500 SFPM (28 m/s), a work speed of 70–100 SFPM (0.46 m/s) traverse rate 4–6" min. (10–15 cm/min) and light infeeds per pass of 0.0005" (0.013 mm). For rough finishing, use work speeds of 12 in/min. (30 cm/min) and slightly higher infeed 0.001" (0.025 mm).

EXAMPLE 2

Tests were made to confirm prior art spraying of similar materials. A powder similar to that of Example 1 was prepared except that the cast iron was between 10 and 90 microns, so as to produce a final composite (clad) powder size between 10 and 120 microns suitable for conventional plasma spraying. A further powder of size 45 to 125 microns has an addition of 3% molybdenum according to the aforementioned U.S. Pat. No. 3,841,901, this powder being sold as Metco TM 449P powder by The Perkin-Elmer Corporation. These powders, as well as the powder of Example 1, were sprayed onto the same substrates as for Example 1 using a plasma spray gun sold as Metco Type 9MB by Perkin-Elmer, using a 707 nozzle, No. 6 powder port, with argon primary gas at 7.0 kg/cm$^2$ (100 psi) and 38 l/min (80 scfh) flow, hydrogen secondary gas at 3.5 kg/cm$^2$ (50 psi) and 7.0 l/min (15 scfh) flow, 300 amperes, 60 volts, spray rate of 5.4 kg/hr (12 lbs/hr) in 5.7 l/min (12 scfh) carrier gas, and 12 cm spray distance. In all cases coatings thicker than 50 microns lifted from the substrate, and no bond strengths could be measured.

EXAMPLE 3

Additional powders are prepared similar to that of Example 1, as follows:

a) iron alloy containing 30% chromium in composite powder of 10% aluminum;
b) iron alloy containing 20% chromium in composite powder of 8% aluminum an 2% molybdenum;
c) iron alloy containing 60% molybdenum in composite powder of 8% aluminum and 2% boron;
d) iron alloy containing 60% molybdenum in composite powder of 10% aluminum;
e) iron alloy containing 2% boron and 0.1% carbon in composite powder of 4% aluminum and 4% molybdenum;
f) iron alloy containing 2% silicon and 0.1% carbon in composite powder of 4% aluminum and 4% molybdenum;

g) 50:50 blend of cast iron and iron alloy containing 60% molybdenum, the blend being in composite powder of 10% aluminum.

Coatings of each of these powders and the powder of Example 1 are sprayed with a similar HVOF gun except using a rotating extension with a 45° angular nozzle as described herein. The gun extension is rotated at 200 rpm and traversed at 37 cm/min. Spray distance is 4 cm. Spraying is effected in the manner of Example 1, except with a #3 injector and, with the same gas pressures, oxygen is 293 l/min (620 scfh), propylene is 67 l/min (141 scfh), and air is 597 l/min (1264 scfh). Coatings 500 microns thick are thereby applied in cylinder bores of aluminum alloy engine blocks. The coatings are finished with a conventional honing tool. The coatings have excellent bonding and scuff and wear resistance.

Coatings are finished by rough honing with A120L6V35P hard chromium stones follow by using Bay State C15018V32 #10 stones and AC120GSV35P soft chromium stones. Final honing is accomplished with Bay State 4005VQZ #10 stones.

EXAMPLE 4

Coatings as described in Examples 1 and 3 were each produced on flat test substrates of mild steel. Each coating was run in an Alpha Model LFW-1 sliding wear testing apparatus, using a 3.5 cm diameter wheel as a mating surface of selected materials similar to clyinder wall materials. The wheel was urged against the coating with an applied load of 45 kg, and rotated at 197 rpm for 60 minutes. The results are shown in the Table "Sliding Wear Tests". Comparisons are made in the table with chrome plate and with several materials thermal sprayed with lower velocity plasma conventionally, the latter materials being sized coarser for the plasma process.

Sliding Wear Tests

| Material | Size (microns) | Process | Coefficient of Friction | Scar Width (mm) |
|---|---|---|---|---|
| Chrome Plate | — | Electrochem | 0.12 | 0.75–0.88 |
| Example 1 | 10–63 | HVOF | 0.12 | 1.13–1.25 |
| | 10–120 | Plasma | 0.13 | 1.50–1.63 |
| Example 3g | 10–63 | HVOF | 0.13 | 1.00–1.13 |
| | 10–120 | Plasma | 0.14 | 1.25–1.38 |
| Example 3a | 10–63 | HVOF | 0.14 | 0.88–1.00 |
| | 10–120 | Plasma | 0.16 | 1.25–1.38 |

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

We claim:

1. A composite thermal spray powder useful for high velocity thermal spraying inside cylinder walls, consisting essentially of aluminum and an iron base metal, wherein the iron base metal consists of cast iron and iron-molybdenum alloy, the aluminum being between 1% and 10% by weight of the total of the aluminum and the iron base metal, and the iron-molybdenum alloy being between about 30% and 70% of the iron base metal.

2. The powder of claim 1 wherein the composite powder has a size distribution predominently between 10 microns and 60 microns.

3. The powder of claim 1 wherein the composite powder comprises granules each formed of aluminum subparticles and iron base subparticles bonded with an organic binder.

4. The powder of claim 3 wherein the aluminum subparticles have a size between about 1 and 20 microns, and the iron base subparticles have a size between about 10 and 44 microns.

* * * * *